United States Patent [19]

Ortiz

[11] 4,394,804

[45] Jul. 26, 1983

[54] ROTOR DRIVEN BUOYANT TOY

[76] Inventor: Nilson V. Ortiz, 2911 16th St. #210, San Francisco, Calif. 94103

[21] Appl. No.: 320,817

[22] Filed: Nov. 12, 1981

[51] Int. Cl.[3] ..... A63H 23/04

[52] U.S. Cl. ..... 46/250; 46/93

[58] Field of Search ..... 46/250, 74 D, 91, 93, 46/248, 249, 75, 74 R

[56] References Cited

U.S. PATENT DOCUMENTS 3,691,670 9/1972 Lemelson ..... 46/249 X 4,249,334 2/1981 Goldfarb et al. ..... 46/249 X

FOREIGN PATENT DOCUMENTS 959436 6/1964 United Kingdom ..... 46/249

OTHER PUBLICATIONS

"Swimming Saucer", *American Modeler,* Aug. 1959, p. 36.

*Primary Examiner*—Mickey Yu

*Attorney, Agent, or Firm*—Robert K. Rhea

[57] ABSTRACT

An inverted generally saucer-shaped buoyant toy, containing a battery powered motor, driving a paddle wheel-type rotor, generates movement of the toy with respect to the body of water in which it floats.

3 Claims, 5 Drawing Figures

ROTOR DRIVEN BUOYANT TOY

BACKGROUND OF THE INVENTION

1. Field of the Invention

The present invention relates to water toys and more particularly to a battery powered rotor driven buoyant toy.

2. Description of the Prior Art

It is common practice to use a dry cell battery and DC motor for mobility of either floating toys or underwater toys, however, so far as I know, no patent discloses a circular spaceship type toy having a driving rotor selectively driven in opposing directions by a battery and motor for movement of a water supported toy.

SUMMARY OF THE INVENTION

A buoyant ring-like body horizontally supports a hollow diametrically disposed housing containing a battery and reversible motor including a control switch for driving a rotor axially secured to the depending end of the vertically disposed motor drive shaft within the ring body.

The principal object is to provide a spaceship saucer-like buoyant amusement toy having a battery powered reversible motor for angular rotation of a rotor in a selected direction and moving the toy.

DESCRIPTION OF THE PREFERRED EMBODIMENT

Figure 2:
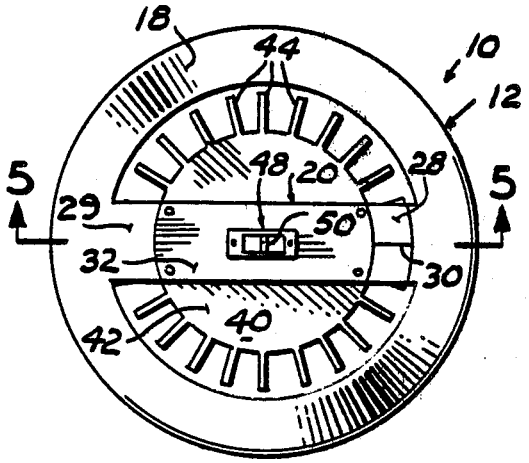
FIG. 2 is a top view of FIG. 1.
Figure 3:
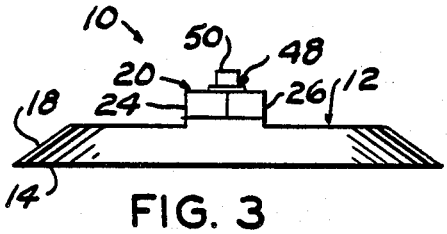
FIG. 3 is a right side elevational view of FIG. 1.
Figure 1:
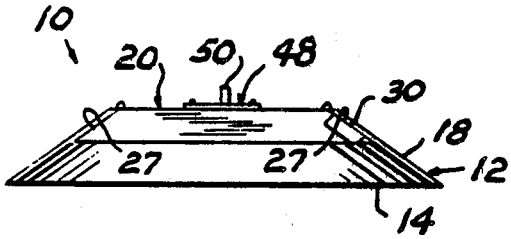
FIG. 1 is a side elevational view.

Like characters of reference designate like parts in those figures of the drawings in which they occur.

In the drawings:

The reference numeral 10 indicates the toy, as a whole, which is inverted saucer-like in general configuration. The toy 10 comprises a buoyant endless ring body 12 having a flat bottom surface 14 and having an inner periphery or wall surface 16 perpendicular to the bottom surface 14 and an upwardly converging outer surface 18 forming the hypotenuse of a right triangular cross section of the body 12. The body 12 diametrically supports a substantially rectangular cabin or housing 20. The housing 20 is characterized by a bottom wall surface 22 extending horizontally between and joined to the inner peripheral wall surface 16 of the body 12 in upwardly spaced relation with respect to the horizontal plane defined by the body bottom surface 14. The housing 20 further includes opposing side walls 24 and 26 secured to the bottom and projecting upwardly above the upper limit of the inclined wall 18. Longitudinal top edge portions of the side walls 24 and 26 are cut off at respective ends, as at 27, to form a continuation of the conical plane defined by the inclined body wall 18. Housing inclined front and rear end walls 28 and 29, respectively, secured to the side wall inclined surfaces 27 form a continuation of the inclined body wall 18 and close the respective ends of the housing. The front wall 28 and an adjacent portion of each side wall is scored and/or colored to simulate a glass enclosed cabin 30. A top wall or lid 32 overlies the side walls and is secured to the end walls of the housing to define a normally closed housing compartment 34.

A reversible DC motor 36 is centrally disposed on and supported by the housing bottom 22 within the compartment 34. The motor drive shaft 38 projects vertically downward through a suitable O-ring sealed opening formed in the housing bottom 22 and is axially connected with a paddle wheel-like rotor 40.

The rotor 40 is freely received within the inner wall surface 16 of the body and is flat disk-like and further characterized by a central rotor portion 42 of reduced diameter. A plurality of fins or blades 44 project outwardly from the perimeter of the rotor central portion 42 in radially equally spaced relation with the vertical plane of the respective fin being normal to the plane of the rotor central portion 42.

A battery, such as a 9 volt dry cell battery 46, contained by the housing chamber 34, is connected by wires to the motor 36 through a control switch 48. The switch 48 is mounted on the housing cover 32 within a suitable opening formed therein. The switch 48 is of the sliding contact type with the normal "off" position of its control button 50 medially the end limits of its longitudinal movement. Movement of the control button in one direction operates the motor for angular rotation in one direction while movement of the switch button 50 to the limit of its movement in the other direction operates the motor 36 for angular rotation of the motor in the opposite direction.

OPERATION

Figure 4:
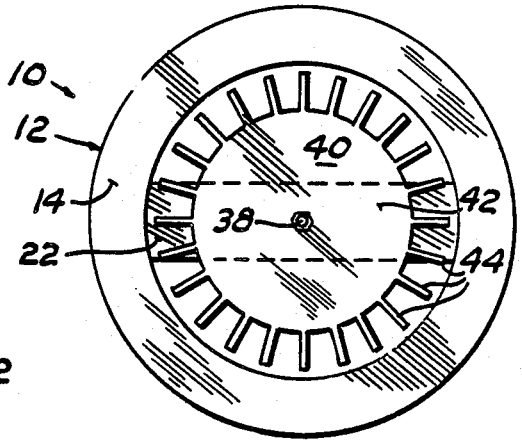
FIG. 4 is a bottom view of FIG. 1.
Figure 5:
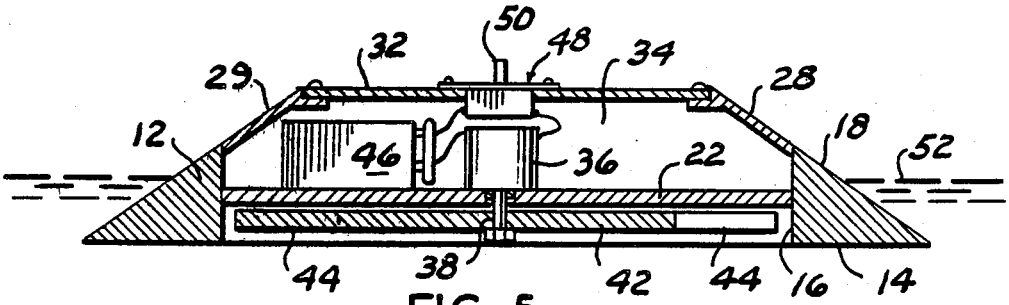
FIG. 5 is a vertical cross sectional view, to a larger scale, taken substantially along the line 5—5 of FIG. 2.

In operation, the toy is assembled, as described hereinabove, and placed in a body of water, indicated by the lines 52, wherein the buoyance of the ring and housing chamber 34 supports the device 10 in substantially the position illustrated by FIG. 4. The switch button 50 is moved to one of its end limits and angular rotation of the motor 36 induces a circular rotation of the water underlying the toy which, after a few moments of operation of the rotor, induces a like rotation of the entire toy and generates a whirlpool action in the body of water near the toy. Moving the switch button 50 to its opposite end limit induces a rotative action of the toy and whirlpool effect in an opposite direction. Angular rotation of the rotor 40 also induces movement of the toy toward one of the boundries defining the limits of the body of water.

Obviously the invention is susceptible to changes or alterations without defeating its practicability. Therefore, I do not wish to be confined to the preferred embodiment shown in the drawings and described herein.

I claim:

1. A floatable toy simulating a space saucer for placement in and movement in water, comprising:

an endless ring body having a planar horizontal bottom surface and an inner peripheral surface normal to its bottom surface;

a hollow housing extending diametrically across and projecting above said body, said housing having a horizontal bottom wall secured to said inner peripheral surface in upwardly spaced relation with respect to said body bottom surface;

motor means within said housing including a reversible motor having a drive shaft projecting downwardly through said housing bottom wall;

a reversing switch mounted on said housing and having a control button projecting above the upper limit of said housing;

a battery within said housing and operatively connected with said motor through said switch; and, paddle wheel means axially secured to said drive shaft and loosely received by the inner peripheral surface of said body for moving said toy.

2. The toy according to claim 2 in which said paddle wheel means comprises:

a disk having a planar central portion and having a plurality of radially extended equally spaced planar fins.

3. The toy according to claim 2 in which said body is characterized by an upwardly converging perimeter intersecting said inner peripheral surface on opposing sides of said housing, said housing having inclined end walls lying in the plane of the converging body perimeter.

* * * * *